United States Patent [19]

Henig

[11] Patent Number: 4,943,072

[45] Date of Patent: Jul. 24, 1990

[54] SIDE-ACTUATED BRAKING SYSTEM FOR PAIRED, WHEELED, FOOT VEHICLES

[76] Inventor: Sy Henig, 3926 Denfeld Ct., Kensington, Md. 20895-1539

[21] Appl. No.: 397,830

[22] Filed: Aug. 24, 1989

[51] Int. Cl.[5] ..... A63C 17/00

[52] U.S. Cl. ..... 280/112; 280/11.23; 280/11.3

[58] Field of Search ..... 280/11.2, 11.21, 11.22, 280/11.23, 11.3, 11.31, 11.33, 614, 615

[56] References Cited

U.S. PATENT DOCUMENTS

| | | | |
|---|---|---|---|
| 321,261 | 6/1885 | Turnbull | 280/11.2 |
| 1,402,010 | 1/1922 | Ormiston | 280/11.21 |
| 3,392,986 | 7/1968 | Ryan et al . | 280/11.115 |
| 3,851,892 | 12/1974 | Swenson | 280/615 |
| 3,871,672 | 3/1975 | Bardy | 280/11.21 |
| 3,945,655 | 3/1976 | Banks et al. | 280/11.2 |
| 4,033,596 | 7/1977 | Andersen et al. | 280/842 |
| 4,050,705 | 9/1977 | Kreis | 280/842 |
| 4,055,234 | 10/1977 | Burton | 188/2 R |
| 4,072,317 | 2/1978 | Pommerening | 280/11.3 |
| 4,102,541 | 7/1978 | Altorfer et al. | 280/242 |
| 4,363,492 | 12/1982 | Eriksson | 280/242 |
| 4,844,491 | 7/1989 | Wheelwright | 280/11.3 |

OTHER PUBLICATIONS

Weiner, "Rocketing Rollerblades—In-Line Skates are the Latest Rage", *The Washington Post,* May 5, 1989.

*Primary Examiner*—Charles A. Marmor

*Assistant Examiner*—Richard Camby

*Attorney, Agent, or Firm*—Lowe, Price, LeBlanc, Becker & Shur

[57] ABSTRACT

A side-actuated braking system using natural foot movements is employed in each of a pair of wheeled, foot vehicles. Each of the vehicles is provided with a braking member including a side-engaging slidable plate, a wheel rotation retardation member such as a caliper, and an interconnection member. The slidable plate is provided at one edge with a row of teeth and is adapted for arrangement on one of a pair of the vehicles with the teeth extending outwardly and opposingly from the foot vehicle for engagement with a similar row of teeth on the other of the pair of vehicles. The interconnection member connects the slidable plate with the wheel rotation retardation member in a manner such that sliding movement of the plate from a first position to a second position actuates the wheel rotation retardation member from a nonbraking position to a braking position. Braking of the foot vehicles is effected by engaging the opposing, toothed edges of their slidable plates, and then moving one foot vehicle forward of the other. The foot vehicles further include an easily mountable and dismountable ankle bracing and shod foot retaining member, and a backstopping member for enabling uphill travel and facilitating level travel. With the side-actuated braking system providing safe downhill travel, these vehicles, for use with conventional walking shoes, constitute a practical transport mode, per se, or auxiliary to mass transit.

14 Claims, 5 Drawing Sheets

SIDE-ACTUATED BRAKING SYSTEM FOR PAIRED, WHEELED, FOOT VEHICLES

FIELD OF THE INVENTION

The present invention relates to a side-actuated braking system for use in a pair of wheeled, foot vehicles, for example, roller skates or roller skis, and to wheeled, foot vehicles adapted to be used in pairs including the side-actuated braking system. The invention also relates to wheeled, foot vehicles including ankle stabilizing means.

BACKGROUND OF THE INVENTION

Various types of wheeled, foot vehicles, for example, roller skates, roller skis, skateboards and the like, are known in the art. It is often desirable to provide foot vehicles with means for controlling the movement of the vehicles, for example, braking means to allow deceleration or stopping, or means for preventing backward movement of the vehicles. For example, the Ormiston U.S. Pat. No. 1,402,010, the Ryan et al U.S. Pat. No. 3,392,986 and the Bardy U.S. Pat. No. 3,871,672 disclose roller skates which include means for preventing reverse rotation of the rollers and consequently rearward or backward movement of the skates. Similarly, the Altorfer et al U.S. Pat. No. 4,102,541 discloses roller skis including a reverse motion blocking device.

Various braking means for use with wheeled or roller foot vehicles are also known. The Turnbull U.S. Pat. No. 321,261 discloses roller skates which include a brake lever arranged at the back of the heel of the skate. The lever on one skate may be depressed using the toe portion of the other skate to apply a brake shoe to one or more rollers of the first skate, resulting in a braking action. The Banks et al U.S. Pat. No. 3,945,655 and the Burton U.S. Pat. No. 4,055,234 disclose skateboards including one or more brake shoes which are forced into contact with a wheel of the skateboard by depressing a pedal attached to the skateboard. The Andersen et al U.S. Pat. No. 4,033,596 discloses a roller ski provided with a leg operated braking means in which braking rods are brought into contact with rollers of the ski by depressing an upwardly extending rod. The Kreis U.S. Pat. No. 4,050,705 discloses a ski scooter including a braking device which is actuated by pulling a brake lever with a ski stick. The brake lever is in turn connected with a brake shoe or the like. Although the braking means for skateboards are generally easily operable, brake means for paired foot vehicles, such as roller skates and roller skis, wherein each foot of the operator is attached to an individual skate or ski are often difficult to operate. Accordingly, there is a need for an improved braking means for paired, wheeled or roller, foot vehicles which allows easy operability by the operator.

It is also desirable to provide foot vehicles with means for retaining the user's foot in or on the vehicle and with ankle stabilizing means which accommodate movement. The Eriksson U.S. Pat. No. 4,363,492 discloses ankle stabilizing means. However, the disclosed ankle stabilizing means has a tendency to cause leg chafing and discomfort. Accordingly, there is also a need for an improved foot retaining and ankle stabilizing means for paired, wheeled or roller, foot vehicles which allows comfortable use by the operator.

SUMMARY OF THE INVENTION

Accordingly, it is an object of the present invention to provide an improved braking system for wheeled, foot vehicles, particularly for wheeled, foot vehicles which are adapted to be used in pairs, such as for example, roller skates or roller skis. It is a further object of the invention to provide a braking system for paired, wheeled, foot vehicles which is easily operable. It is a related object of the invention to provide a braking system for paired, wheeled, foot vehicles which may be activated by natural cooperative motion between the operator's feet. It is a further object of the invention to provide a braking system for paired, wheeled, foot vehicles, which braking system provides safe deceleration and stopping of the foot vehicles. An additional object of the invention is to provide paired, foot vehicles including an improved, easily operable braking system, and to provide paired, foot vehicles which allow safe downhill travel through easily controlled deceleration and stopping.

Another important object of the invention is to provide foot vehicles which permit the use of conventional walking shoes therewith and allow easy mounting and dismounting by the operator. Thus, the operator may quickly and conveniently switch to a complementary mode of transportation, whereby these vehicles may be easily carried aboard.

These and additional objects are provided by the present invention which comprises a side-actuated braking means for use in each of a pair of wheeled, foot vehicles. The side-actuated braking means of the invention comprises a side-engageable slidable plate, a wheel rotation retardation means, and an interconnection means connecting the slidable plate with the wheel retardation means. The slidable plate is provided at one edge with a row of teeth and is adapted for arrangement on one of a pair of wheeled, foot vehicles with the teeth extending outwardly and opposingly from the foot vehicle for engagement with a facing similar row of teeth included in a similar braking means provided on the other of the pair of wheeled, foot vehicles. In one preferred embodiment, the wheel rotation retardation means comprises at least one caliper. Typically in this specification, a caliper comprises a pair of levers wherein each lever includes a longer arm having a force input end and a shorter arm having a force output end. The longer arm having the input end, as will be described, receives force from the interconnection means and functions as a force multiplier; and the shorter arm functions as a caliper jaw, or pincer, for applying braking force to a wheel or other inrermediate device. The interconnection means connects the slidable plate with the caliper in a manner such that sliding movement of the plate from a first non-braking position to a second braking position moves the caliper from an open position to a closed position where the pair of levers grips a wheel of the vehicle to provide a braking action.

Engagement of the rows of teeth on the respective foot vehicles followed by movement of one foot vehicle relative to the other causes sliding movement of the slidable plate in each braking means. Thus, when an operator wears a wheeled, foot vehicle on each foot and each vehicle includes the braking means of the present invention, the operator may bring the wheeled vehicles together while rolling so that the respective teeth engage, for example in the same manner as gear teeth, and then move one foot vehicle forward relative to the other and cause the braking action on the wheels of the vehicles. Moreover, this longitudinal displacement of the engaged vehicles effects a longer wheel-base which helps counter the overturning force produced by braking. Thus, the braking system of the invention is easily activated by a natural cooperative motion between the operator's feet, and is easily deactivated by parting the foot vehicles to disengage the teeth.

Throughout the present specification, the application of a gripping force or braking force to the wheels of a foot vehicle is described. It should be understood that such descriptions encompass embodiments wherein the gripping or braking force is applied to the wheel via thread guards or brake pads and also wherein the gripping or braking force is applied to a member other than the wheel, which member is keyed, linked or affixed in rotation to the wheel.

The wheeled, foot vehicles according to the present invention are also preferably provided with a backstopping means which prevents backward movement and facilitates uphill travel and with ankle stabilizing means in order to provide easily operable foot vehicles.

These and additional objects and advantages provided by the present invention will become more apparent in view of the following detailed description.

BRIEF DESCRIPTION OF THE DRAWING

The following detailed description will be more fully understood when viewed in connection with the drawing in which.

DETAILED DESCRIPTION

Figure 1:
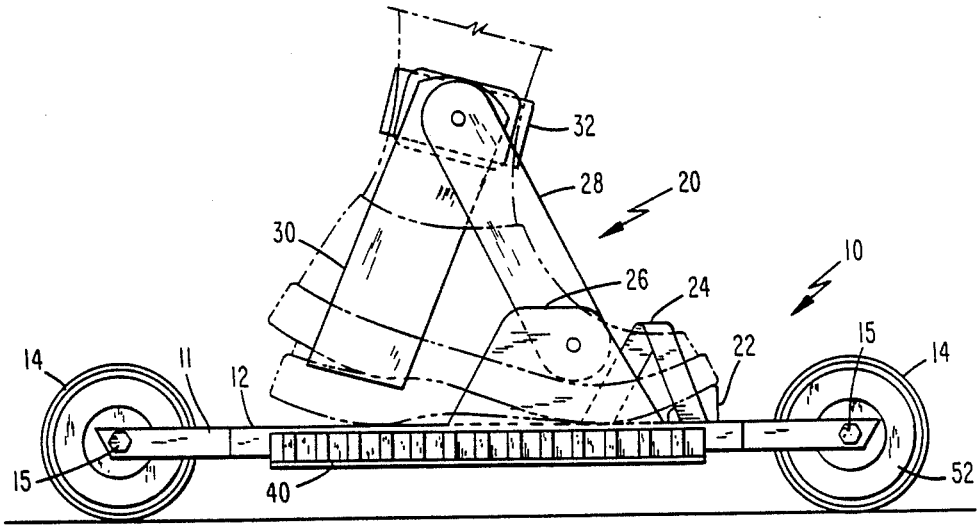
FIG. 1 represents a side view of a roller ski in which the braking means, foot retaining means and ankle stabilizing means according to the present invention are included.

The side-actuated braking system of the present invention is intended for use in a pair of wheeled, foot vehicles. The wheeled, foot vehicles may be, for example, roller skates or roller skis or the like. FIG. 1 discloses one of a pair of roller skis in which the side-actuated braking system of the present invention may be employed. The roller ski 10 includes a carriage frame 11 incorporating a platform 12 for receiving a foot of the vehicle operator and at least two, and preferably only two, wheels 14, each of which is mounted on a hex shaft 15 at each end of the platform. In a preferred embodiment, the wheels comprise resilient tires having a crowned tread which provides improved maneuverability on curves. The foot vehicle also includes means for retaining the user's foot on the platform, which means are indicated in FIG. 1 generally at 20. The foot retaining means may comprise one or more straps, a shoe covering or any other foot retaining means known in the ski and skate art.

The utility of paired, wheeled foot vehicles is considerably enhanced when the foot vehicles are easily adaptive to conventional walking shoes worn by the operator. Thus, ease of mounting and dismounting the vehicles is provided. As indicated in FIG. 1 and in all following references, "foot retaining means" invariably accommodates the use of shoes. Included with a foot retaining means is an ankle stabilizing linkage, such linkage being pivotable in vertical-longitudinal planes, being rigid in vertical-lateral planes, and comprising a cuff-like, cushioned strap for wrapping around the operator's leg, a brace mount rigidly attached to the platform, and an intermediate link pivotally attached to both. In this arrangement, only fastening and unfastening the leg strap is required in mounting and dismounting, respectively.

Figure 2:
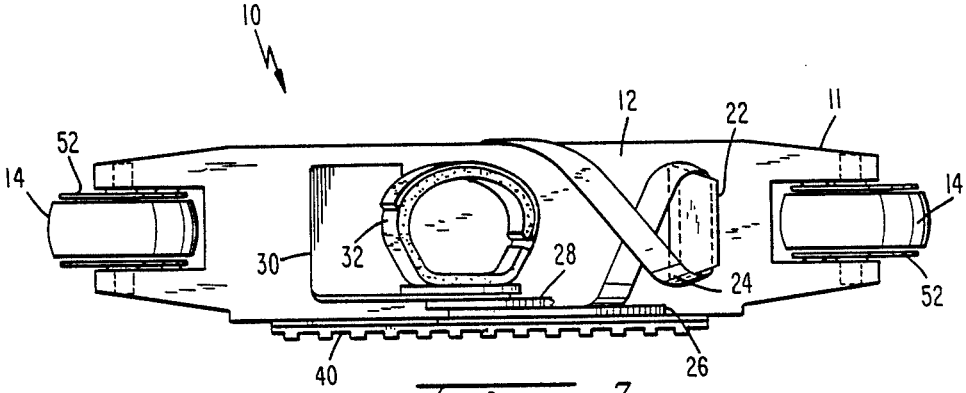
FIG. 2 represents a top view of a roller ski device as shown in FIG. 1 and including the braking means, the foot retaining means and the ankle stabilizing means according to the present invention.

A preferred foot retaining means is disclosed in FIGS. 1 and 2 and includes restraining and/or stabilizing means at three places, namely the forward part of the foot, the aft part or heel of the foot and the operator's leg at an area above the ankle. Specifically, a shoe stop 22 and strap 24 are provided for retaining the toe or forward part of the foot effectively in a pocket. The strap may be permanently secured to the platform so that the operator need only slip the forward portion of the foot therein as shown in FIG. 1, or the strap may be provided with a releasable securing means such as snaps, buckles, Velcro® or the like. A brace mount 26 is secured at an edge of the platform 12. A brace link 28 is pivotally attached to the brace mount and, in turn, a stirrup 30 for supporting the heel portion of the foot is pivotally attached to the brace link 28. A second strap 32 is also pivotally attached to the brace link and is provided for mounting around a leg portion above the ankle of the operator. The strap 32 may be provided with closure means such as Velcro® fasteners, snaps or the like to provide easy attachment and detachment. Although shown in FIGS. 1 and 2 as being mounted on the engaging side of the roller ski, the brace members may similarly be applied on the other side of the foot vehicle. In either instance, these brace members are arranged so as not to interfere with the side-actuated braking means of the invention.

The foot retaining means disclosed in FIGS. 1 and 2 is advantageous in providing both constraining forces and movement accommodation to the operator's foot. The pivoting capability of the linked members permits the operator's heel to be raised for natural foot movement as is characteristic of cross-country snow skiing. At the same time, the lateral rigidity of the linkage providing guidance from the leg causes the platform to move with the leg to provide lateral stability and prevent wobbling. Additionally, because leg support is provided above the ankle, the ankle is by-passed where its lateral directional strength is usually undeveloped and therefore is stabilized. The disclosed retaining means is therefore suitable and complementary for use with crowned tires which favor banking for curves.

The roller ski foot vehicle shown in FIGS. 1 and 2 includes the side-actuated braking means of the invention. Specifically, FIGS. 1 and 2 show the row of teeth included in the side-actuated braking means 40. Generally, the braking means according to the present invention includes a slidable plate, wheel rotation retardation means, and an interconnection means connecting the slidable plate with the wheel retardation means. As will be set forth in detail below, the slidable plate is generally adapted for mounting under the platform of the wheeled, foot vehicle and includes a row of teeth along one edge. The slidable plate is arranged on each foot vehicle so that the row of teeth extends outwardly to face the opposing side of the other foot vehicle.

Thus, when the braking system is used with paired, foot vehicles, both of which include the side-actuated braking means of the invention, the rows of teeth from each respective braking means extend outwardly towards one another and are capable of engagement with one another. When the teeth of the respective braking means are engaged, longitudinal movement of one foot vehicle relative to the other will cause sliding movement of the slidable plate in each braking means from a first, non-braking position to a second, braking position. Each slidable plate operates bi-directionally, forward or backward, so that either foot moved forward of the other causes the slidable plates to move in opposite directions, each toward a braking position The braking means further includes wheel rotation retardation means, for example, at least one caliper comprising a pair of levers which is movable between an open position and a closed position and which is adapted for arrangement on the foot vehicle so that in closed position the pair of levers applies force to or grips the sides of a wheel of the foot vehicle to provide a braking action. An interconnection means is also provided in the braking means, which interconnection means connects the slidable plate with the caliper in a manner such that the sliding movement of the plate from a first, non-braking position to a second, braking position moves the caliper from an open position to a closed position to provide the braking action.

Although it is preferred that a row of teeth is provided on a flange of each slidable plate included in a pair of wheeled, foot vehicles according to the invention, other engaging means may be used within the scope of the invention in place of the rows of teeth. For example, friction materials such as the loop component of Velcro®, rough textured elastomer, or the like may be used in place of each row of teeth. Standard industrial timing belts use a tooth-form which is entirely suitable for engaging and disengaging, and a length of such material can provide the preferred row of teeth.

As will be set forth in detail below, the slidable plate is preferably spring biased in a first non-braking position. Sliding movement of the plate to a second position other than the first position moves the caliper comprising a pair of levers from open position to closed position through the interconnection means. To ensure release of the braking means once the teeth of opposite foot vehicles are disengaged, the levers of the caliper may also be spring biased in open position.

Figure 3:
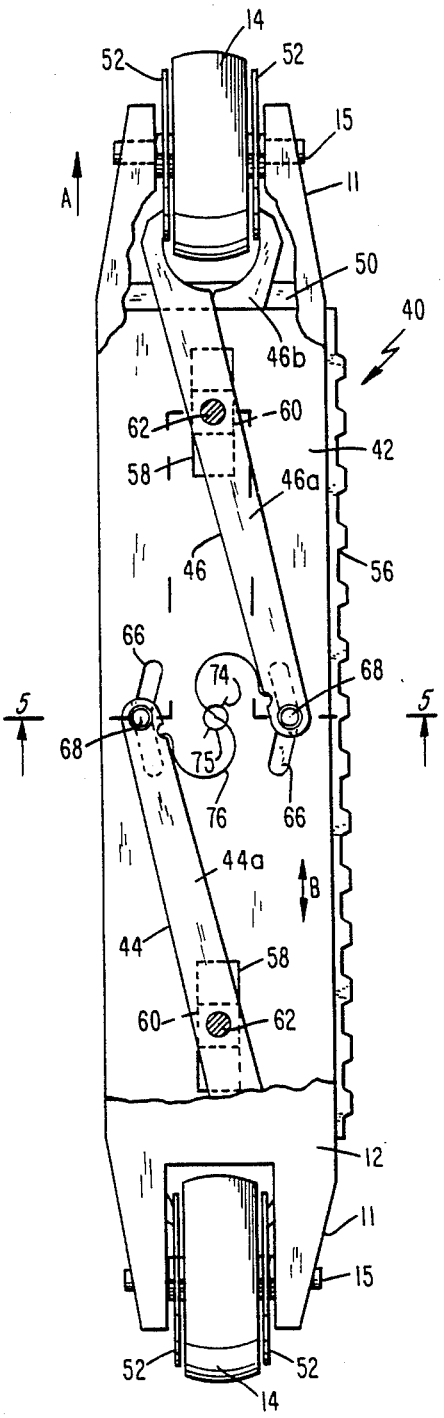
FIG. 3 represents a top view of a first embodiment of the braking means according to the present invention included on a two-wheeled, foot vehicle.
Figure 4:
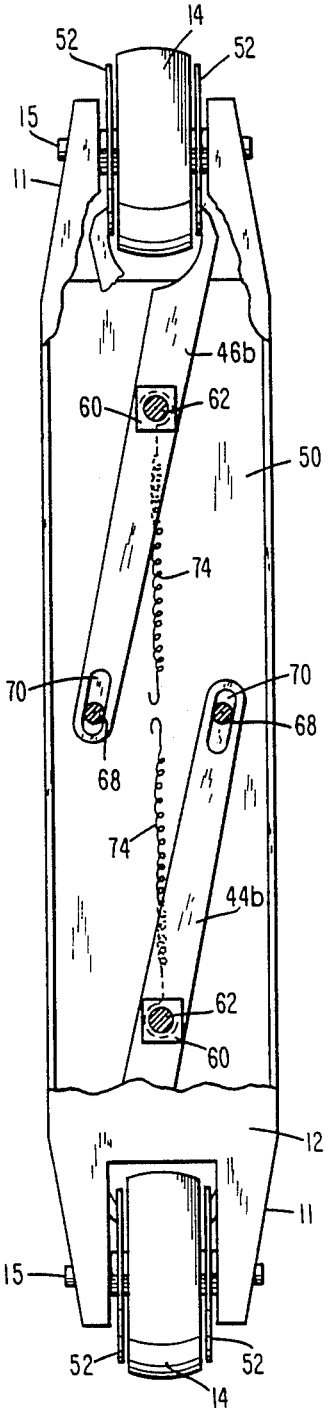
FIG. 4 represents a top view of a portion of the braking means set forth in FIG. 3.
Figure 5:
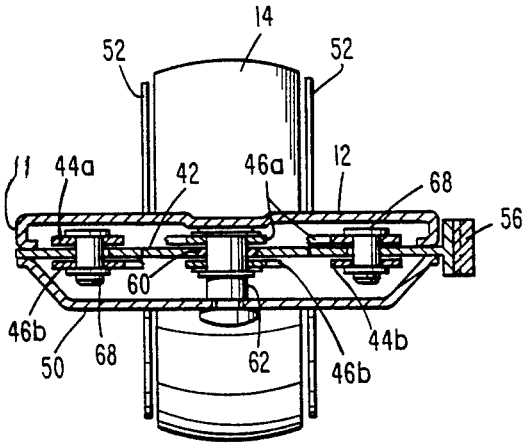
FIG. 5 represents an enlarged cross-sectional view taken along line 5—5 of FIG. 3.
Figure 7:
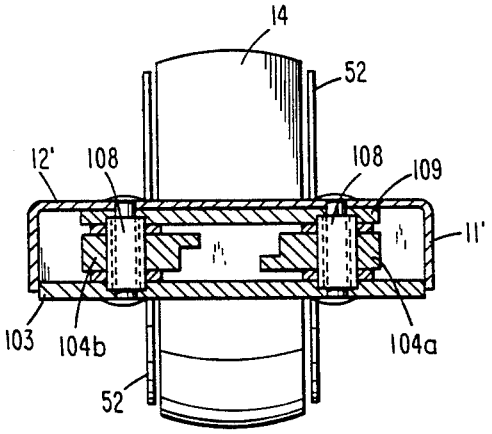
FIGS. 7, 8 and 9 represent enlarged cross-sectional views taken along lines 7—7, 8—8 and 9—9 of FIG. 6.

Specific embodiments of the side-actuated braking means according to the present invention are set forth in FIGS. 3–9 and 13–15. FIG. 3 represents a top view of a first embodiment of the side-actuated braking means mounted on a two-wheeled, foot vehicle with a portion of the platform, on which an operator's foot rests, being broken away. FIG. 4 represents another view of the embodiment set forth in FIG. 3 with the slidable plate and other members thereabove removed. FIG. 5 represents a cross-sectional view taken along line 5—5 of FIG. 3.

With reference to FIGS. 3–5, the side-actuated braking means 40 includes a slidable plate 42, a caliper 44 including a pair of levers **44*a* and 44*b*, a caliper 46 including a pair of levers 46*a* and 46*b*, and interconnection means comprising a series of cam slots, follower or link pins and link pin slots for connecting the slidable plate 42 with the calipers 44 and 46. The foot vehicle in which the braking means is included includes the carriage frame 11 having a platform 12, two wheels 14 and a bottom shield plate 50 which attaches to the platform. The wheels are also provided with thread guards 52** to which the braking force is applied. Preferably, the thread guards are formed of a material which allows them to spring back to a position which does not contact the wheel once the braking forces are removed. Although not shown in most figures, brake pads or the like may be included in place of or in addition to the thread guards where necessary as required by the frictional interaction between materials which contact during the braking action. The carriage frame, besides incorporating the platform, mounts the wheels, and may be provided with wheel covering or housing portions, so as to provide shielding to brake members and the operator as is well known in the art.

For all embodiments of vehicles using wheels incorporating backstopping means in this invention, a hex shaft 15 (FIG. 1) keying into hex-bored holes in thread guards, inner races of bearings, and an inner member of the backstopping means holds these members non-rotational by similarly keying into or being fastened to the carriage frame.

The slidable plate 42 includes a row of teeth 56 and is arranged on the foot vehicle so that the row of teeth extends outwardly from the side of the foot vehicle. The foot vehicle shown in FIG. 3 moves in a forward direction as indicated by arrow A whereby this vehicle is adapted for use on the left foot of the vehicle operator so that the row of teeth 56 extends opposingly toward the other foot vehicle. The slidable plate 42 is slidable in a generally horizontal attitude parallel with the direction of travel, in both forward or backward directions. When the row of teeth 56 is in engagement with a similar row of teeth provided on a right foot vehicle of a pair and the operator moves the left and right vehicles relative to one another, the slidable plate of the braking means of each vehicle slides, with the respective plates of each vehicle sliding in opposite directions.

As indicated by arrow B, the slidable plate may move either forward or backward. The slidable plate moves relative to the remainder of the foot vehicle, namely the carriage frame 11, the bottom shield plate 50 and the wheels 14. The sliding movement of the plate 42 is constrained by slider slots 58 contained in the plate and slider blocks 60 positioned in the slots 58. The slider blocks 60 are shown partially hidden in FIG. 3 and are shown fully in FIG. 4. Also mounted within the slider blocks 60 are pivot posts 62 on which the levers of each caliper are mounted for pivotal movement. The slidable plate 42 is thereby limited in its length of movement by the lengths of the slots 58 and the blocks 60. These slots and blocks not only limit the distance of sliding movement of the plate 42 but also maintain the straight direction of the sliding movement of the plate.

As set forth above, each of the calipers included in the braking system of the invention includes a pair of levers, the caliper 44 including levers 44*a* and 44*b* and the caliper 46 including levers 46*a* and 46*b*. The pairs of levers are pivotally connected at the pivot posts 62. As shown in FIG. 3, levers 44*a* and 46*a* are located above the slidable plate 42 while, as shown in FIG. 4, the levers 44*b* and 46*b* are located below the slidable plate 42, with all the levers being oriented in and operating in planes generally parallel with the slidable plate. The caliper levers are so arranged in order to facilitate use of the specific interconnection means shown in FIGS. 3–5 which will be described below. It is equally within the scope of the present invention that both levers of each caliper may be located above or below the slidable plate. The important feature is that the sliding plate and the calipers are connected in a manner such that sliding movement of the plate from a first, non-braking position to a second, braking position moves the levers from an open position shown in FIG. 3 to a closed position wherein the levers of each caliper grip the respective wheel of the foot vehicle.

In the embodiment of FIGS. 3–5, the interconnection means comprises at least one cam slot provided in the slidable plate and at least one link pin extending from a lever into the cam slot. The cam slot is of a configuration which acts as a cam to move the corresponding link pin functioning as a cam follower along with the lever attached thereto to an inward position as the slidable plate is moved from a first, non-braking position to a second, braking position. For example, with reference to FIG. 3, slidable plate 42 is provided with cam slots 66. The upper caliper levers 44*a* and 46*a* are each provided with a downwardly extending link pin 68 which extends into the corresponding cam slot 66. Each cam slot 66 is V-shaped and, in the non-braking position of the slidable plate, each link pin 68 extending from its upper caliper lever is located in the respective slot 66 at the apex of the V-shaped slot. As the slidable plate is moved in either a forward or backward direction as shown by arrow B, the slots 66 act as cams to move the link pins and the caliper levers attached thereto to a closed position.

Additionally, as shown in FIG. 4, the lower portion of the pins 68 extend into link pin slots 70 provided in each of the lower caliper levers 44*b* and 46*b*. As the pins are moved toward each other by the cam slots 66 contained in the slidable plate, the pins 68 act as link pins in the link pin slots 70 and thereby move the lower caliper levers 44*b* and 46*b* to a closed position. Therefore, the levers' link pins and, in turn, these pins and the counterpart levers, link pin slots comprise lever input devices. Thus, the interconnection means comprising slots 66, pins 68 and slots 70 connect the slidable plate 42 with the calipers 44 and 46 in a manner such that sliding movement of the plate 42 from first to second position causes the calipers 44 and 46 to move from open positions to closed positions in which the jawed, output ends of the pairs of levers grip the wheels of the vehicle to provide a braking action. As set forth above, the sliding movement of the plate 42 is provided by engaging the respective rows of teeth provided in a pair of wheeled vehicles, each of which includes the side-actuated braking means of the invention, and moving one foot vehicle relative to the other foot vehicle. Since the braking means set forth in FIGS. 3–5 is essentially symmetrical, both left and right and fore and aft, the braking movement between left and right foot vehicles may be done with either foot moved forward relative to the other while the opposing rows of teeth are engaged. Additionally, the braking system allows the braking action to be actuated simultaneously on all of the wheels of both of the paired foot vehicles.

Preferably, the slidable plate 42 is biased in the first, non-braking position. The slidable plate may be so biased, for example, by means of springs 74, one end of each of which is attached to any convenient stationary portion of the foot vehicle, for example, pivot posts 62 or the bottom shield plate 50. The springs 74 shown in FIG. 4 are adapted for attachment at their adjacent ends to a central hole 75 included in the slidable plate. Further, the thread guards 52, when employed, will spring back to clear the wheels and push back on the levers when the braking action is discontinued. Additionally, the paired levers may also be spring biased to their open position in order to ensure release of the braking action when the slidable plate returns to its non-braking position. As shown in FIG. 3, upper caliper levers 44*a* and 46*a* are spring biased in the open position by means of a flat wire spring 76.

Figure 6:
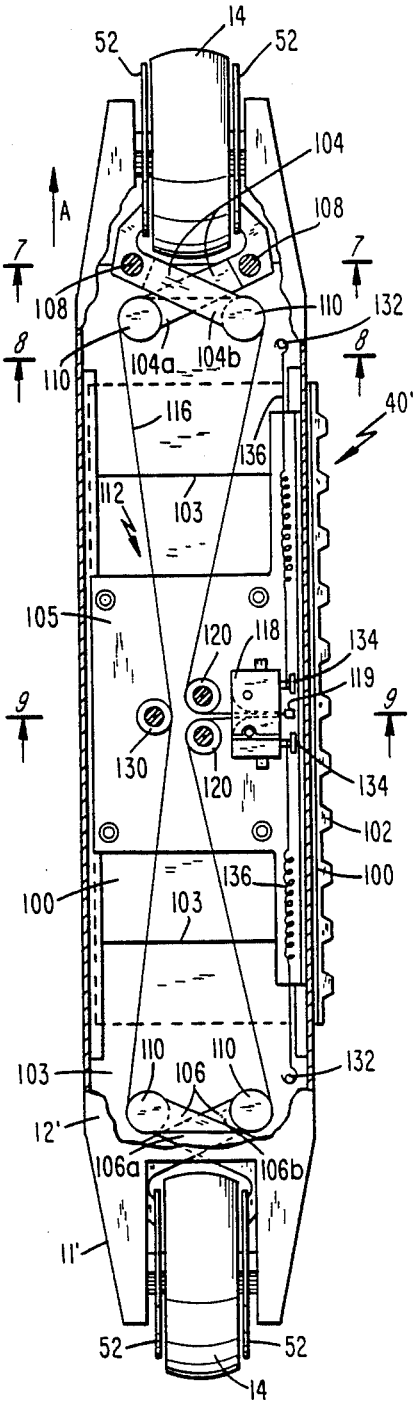
FIG. 6 represents a top view of a second embodiment of the braking means according to the present invention included on a two-wheeled foot vehicle.

The interconnection means comprising the described cam slots, link pins and link pin slots described in FIGS. 3–5 may be replaced with other types of interconnection means which provide the necessary connecting function. For example, FIGS. 6–9 disclose a second, preferred embodiment of the side-actuated braking means according to the present invention. With reference to FIG. 6, the braking means 40' includes a slidable plate 100 provided with a row of teeth 102. As in the previous embodiment, the slidable plate is arranged on the foot vehicle so that the row of teeth extends outwardly and opposingly from the foot vehicle for engagement with a facing, similar row of teeth extending from the other of the pair of foot vehicles. Owing to the arrangement of the slidable plate and the row of teeth set forth in the top view, FIG. 6, and arrow A indicating travel direction, the foot vehicle of FIG. 6 is adapted for use on the left foot of the vehicle operator.

Figure 9:
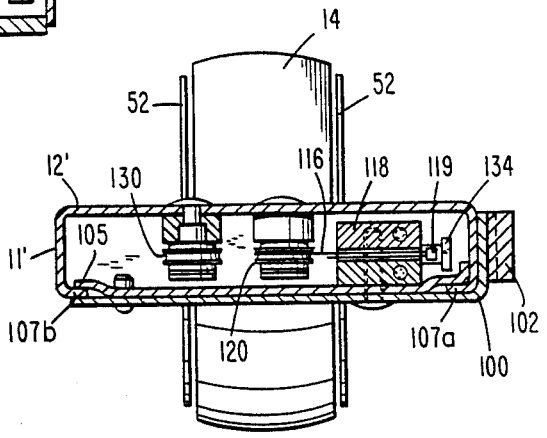

The vehicle shown in FIG. 6 includes a carriage frame 11', a lower closure plate 103 at each end and two wheels 14 including thread guards 52. The slidable plate 100 is secured to a gib plate 105 and, as shown in FIG. 9, the slidable plate 100 and the gib plate 105 are arranged at their bent lateral edges around a lower flanged edge 107*a* of the carriage frame 11'. The unbent opposite edges of slidable plate 100 and gib plate 105 are arranged to lightly pinch the opposite lower flanged edge 107*b* of carriage frame 11'. In this arrangement, the gib plate and the slidable plate may slide along and are retained and guided linearly on the lower edge portions 107*a* and 107*b* of the carriage frame 11'.

The braking means further includes calipers 104 and 106, each of which are movable between an open position as shown in FIG. 6 and a closed position in which a pair of levers grips a wheel of the foot vehicle via intermediate thread guards to provide a braking action. Caliper 104 includes a pair of levers 104*a* and 104*b* also shown in FIG. 7, which are pivotally secured to the platform 12', a bolster plate 109 and the lower closure plate 103 by means of pivot posts 108 shown here and in FIG. 6. Caliper 106, comprising levers 106*a* and 106*b*, is similarly mounted. Each lever 104*a*, 104*b*, 106*a* and 106*b* includes at its force input end a lever input device, namely lever pulley 110, which constitutes a portion of the interconnection means between the slidable plate 100 and the calipers 104 and 106.

As further set forth in the interconnection means of FIG. 6, the lever pulleys are encircled by a cable loop arrangement for connecting the slidable plate with the calipers in a manner such that sliding movement of the plate from a first, non-braking position to a second, braking position moves the calipers from open positions to closed positions. The cable loop arrangement includes a cable assembly 112 for use in connection with calipers 104 and 106. The cable assembly includes a cable 116, a cable loop terminal 119, and an anchor block 118 which is mounted on the slidable plate.

The anchor block comprises two identical half-pieces and two clamping screws. The screws draw the half-pieces together for pinching the cable ends just before the loop terminal 119 to which the cable ends are secured. Each half-piece has a three-step configuration with one end of the middle step having a quarter-round shape, shown as hidden lines in FIG. 6. The straight riser side of the middle step provides the pinching surface. Where the step is quarter-rounded, the two cable ends are provided with a low stress guide for the two-way pulling action as will be discussed below. The block is assembled with one half-piece inverted with respect to the other, such that the treads of the first step of the one piece and the second step of the other piece overlap to form a confinement chamber for pinching and guiding the cable ends.

The intermediate portion of the cable 116 travels around the lever pulleys 110 included as force input means of calipers 104 and 106. Each end portion of the cable travels around a respective central pulley 120 which is mounted adjacent the anchor block 118. The central pulleys 120 are positioned stationary with the carriage frame. For example, as shown in FIG. 9, the central pulleys 120 may be mounted on the underside of the platform 12'.

The anchor block is positioned on the slidable plate so that, as the slidable plate is moved from a first non-braking position to a second braking position, the cable pulls on the lever pulleys and the caliper levers attached thereto move each caliper from open position to closed position. The central pulleys 120 constrain the cable 116 to feed out its end portions in accordance with any sliding movement of the slidable plate 100, thus decreasing the length of the cable 116 wrapped around the lever pulleys 110 so as to result in the closing movement of the calipers 104 and 106. This is shown in FIG. 6 where, in the cable assembly 112, the cable travels from the anchor block around a first of the central pulleys, around all lever pulleys and then around the other of the central pulleys.

Additionally, the cable loop arrangement may further include at least one equalizing pulley 130 which is also positioned stationary with respect to the carriage frame and which is positioned to specially shape the cable loop. Equalizing pulleys 130 are arranged so that the angle of the cable off each lever pulley is the same, whereby forces applied to all caliper levers by the cable 116 as a result of sliding movement of plate 100 are equal. In this embodiment, the side-actuated braking system controls the braking action for both wheels of one foot vehicle and both wheels of the other of the paired, foot vehicles simultaneously. Likewise, since the engaged teeth of the pair of vehicles exert equal forces to their respective slidable plates, thereby creating substantially uniform tensions in the respective cables, all levers impart braking forces in an equalized manner to each respective wheel of the paired, foot vehicles.

Figure 8:
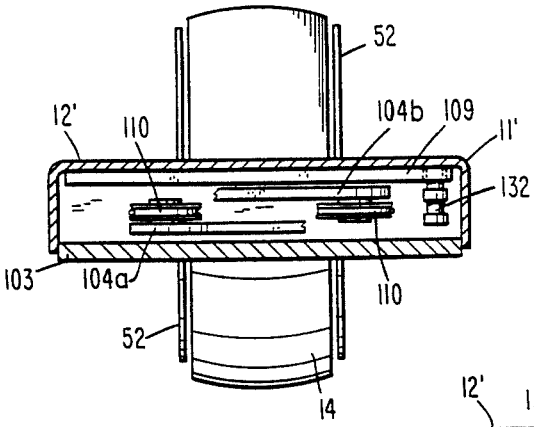

As with the embodiment of FIGS. 3–5, the slidable plate 100 may be spring biased in the first non-braking position and/or the calipers may be spring biased in the open position. As shown in FIGS. 6 and 8, spring posts 132 are provided on the bolster plate 109, and spring posts 134 are provided on the anchor block 118. Springs 136 extend between posts 132 and posts 134 to bias the slidable plate in a non-braking position.

The two differing specific embodiments of the braking system including the slidable plates, the calipers and the interconnection means set forth in FIGS. 3–9 demonstrate that various additional embodiments and modifications are possible without departing from the inventive combination of the side-engaging slidable plates, the calipers and the interconnection means. Thus, although the braking system of the invention has been demonstrated for use on two-wheeled, foot vehicles, braking system may similarly be used on three-, four- or more-wheeled vehicles. In this regard, attention is directed to FIGS. 13 and 14 which show schematic diagrams of side-actuated braking means according to the present invention for use with a four-wheeled, foot vehicle.

Figure 13:
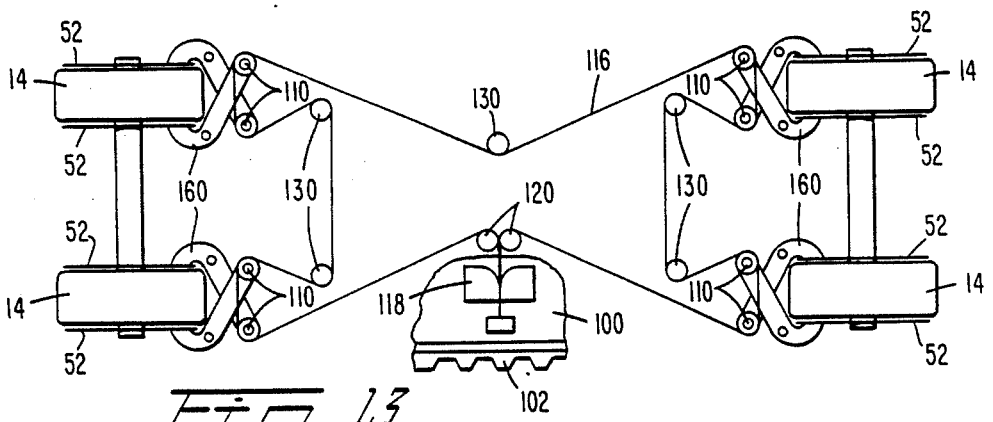
FIGS. 13 and 14 are schematic views of four-wheeled, foot vehicles including the side-actuated braking means of the invention.
Figure 14:
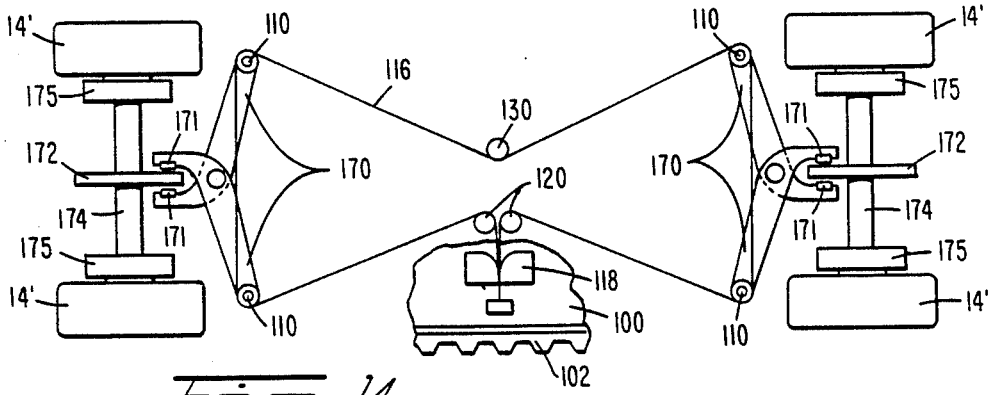
Figure 15:
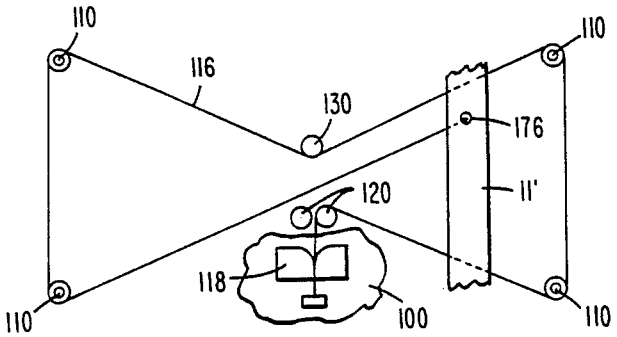
FIG. 15 is a schematic view of an alternative embodiment of the braking means according to the invention.

More particularly, in the embodiment of FIG. 13, a caliper 160 comprising a pair of levers is provided for transmitting a braking action to each wheel 14 via the thread guards 52. A lever pulley 110 is provided on each lever, central pulleys 120 are provided adjacent the anchor block 118, and five equalizing pulleys 130 are provided so that the angle of the cable 116 off each lever pulley is the same, whereby the braking force applied to each lever is the same. The central pulleys 120 and the equalizing pulleys 130 are positioned stationary with the carriage frame. In the embodiment of FIG. 14, a caliper 170 comprising a pair of levers is provided for transmitting a braking action to a brake disc 172 which is keyed together with the axle 174 and two wheels 14, laterally disposed at forward and rear wheel positions. Bearings 175, optionally incorporating one-way clutches, are mounted on axles 174, and are provided for suspension from a carriage frame. Brake pads 171, provided on the output ends of the levers, contact the brake discs. A lever pulley 110 is provided on each lever, central pulleys 120 are provided adjacent the anchor block 118, and an equalizing pulley 130 is provided so that the angle of the cable 116 off each lever pulley is the same, whereby the braking force applied to each lever is the same. The central pulleys 120 and the equalizing pulley 130 are positioned stationary with respect to the carriage frame.

The braking means shown in FIGS. 13 and 14 operate in the same manner as that shown in FIGS. 6–9. The anchor block is positioned on the slidable plate so that as the slidable plate is moved from a first non-braking position to a second braking position, the cable pulls on the lever pulleys and the caliper levers attached thereto to move each caliper from open position to closed position. The central pulleys 120 constrain the cable 116 to feed out its end portions in accordance with any sliding movement of the slidable plate 100, thus decreasing the length of the cable 116 wrapped around the lever pulleys 110 so as to result in the closing movement of all calipers 160 or 170.

As would be obvious to a practitioner of the art, the cable ends of the foregoing-described arrangement relative to FIGS. 6, 13 and 14 may be anchored separately such that one end is held by the anchor block and the other end is held by a second anchor means which is mounted to a carriage frame member. For example, in FIG. 15, one end of the cable 116 is held by anchor block 118 and the other end is held by anchor means 176 which is mounted to the carriage frame member 11, Thus, the second anchor means 176 holds its cable end stationary as compared to the anchor block 118 and the cable end attached thereto which move with the slidable plate 100. In this arrangement, force transmitted to the lever pulleys is doubled, and the distance moved by the slidable plate is doubled when the calipers are actuated from open to closed positions as compared with the previously described anchoring method.

The foot vehicles according to the present invention may also include a backstopping means which prevents the wheeled, foot vehicle from traveling in a reverse direction. The backstopping means thereby facilitates traverse of hills and the like. Various backstopping means such as overrunning clutches known in the art may be used in combination with the side-actuated braking system of the present invention in wheeled, foot vehicles. A suitable wheel assembly and backstopping clutch means are disclosed in FIGS. 10–12.

Figure 10:
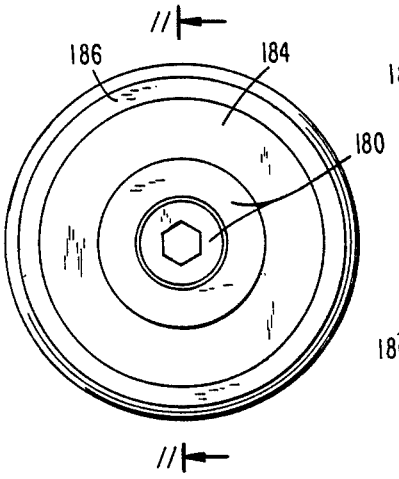
FIG. 10 is a side view of a wheel including tire and bearings for use on a wheeled, foot vehicle.
Figure 11:
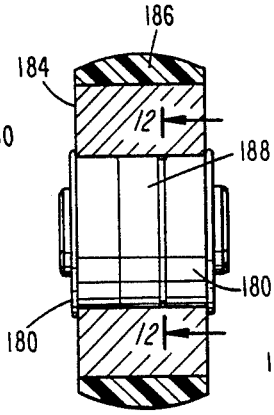
FIG. 11 represents a cross-sectional view taken along line 11—11 of FIG. 10 showing internal backstopping means.
Figure 12:
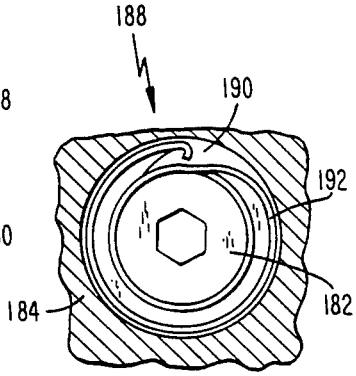
FIG. 12, taken along line 12—12 of FIG. 11, represents an internal side view of the backstopping means shown in FIG. 11.

FIG. 10 is a side view and FIG. 11 is a cross-sectional view of the wheel assembly which includes two hex bore ball bearings 180, a wheel 184 with crowned resilient tire tread 186 and a clutch 188. The clutch shown in side view detail in FIG. 12 includes drum 182 provided with a hex bore, a spring dog 190 cemented centrally in the wheel's bore and a wrap spring 192. The hex bore as shown in FIG. 10 is through the bearings' inner races, of which each projects outwardly as shown in FIG. 11. The hex bore drum 182 shown in FIG. 12 is sandwiched between the inner races of the two bearings indicated in FIG. 11. The hex shaft 15, as shown in FIG. 1, keys the races, the drum and the thread guards; and the shaft, being keyed or fastened to the carriage frame (of which the platform is part), renders all these members non-rotating. With the spring dog 190 in place, one bearing is pressed into the wheel's bore (via the outer race), the spring and drum are placed in position and become retained when the second bearing is pressed in. One or more of the spring's coils wrap the dog's shoulder while several other coils wrap the drum. The spring's hook in the dog's shoulder cavity causes the spring to rotate as the wheel and bearing outer races rotate in one direction only, and likewise causes a lock-up to the drum, shaft and carriage frame when any reversing force counters that one direction.

When the wheel rotates in the forward direction of travel, the frictional contact between the spring and the drum loosens the wrap of the spring's coils. However, if the wheel attempts rotation in the backward direction, the spring wraps tightly on the drum and dog and prevents further backward rotation of the wheel. Other bearing and backstopping means may be used in connection with foot vehicles which include the side-actuated braking system of the invention. A suitable commercially available unit comprises the Torrington type DC Roller Clutch/Bearing assembly.

The specific embodiments set forth in the specification are to illustrate the novel braking system of the invention and are not intended to limit the scope of the presently claimed apparatus. For instance, although caliper brakes are well-known and widely used in vehicle technology, it will be obvious to practitioners that a variety of other known devices for controllable retardation of wheel rotation can be adapted to side-actuated braking. Thus, additional embodiments having advantages within the scope of the claimed invention will be apparent to one of ordinary skill in the art.

What is claimed is:

1. Side-actuated braking system for use in a pair of wheeled, foot vehicles, comprising, in each vehicle, a side-actuated braking means comprising (a) a slidable plate provided at one edge with a row of teeth, said plate being attached to one of a pair of wheeled, foot vehicles so that the row of teeth extends outwardly and opposingly from a side of the one foot vehicle to face and adapted for engagement with a similar row of teeth outwardly extending from the opposing side of the other of the pair of wheeled, foot vehicles, whereby movement of either foot vehicle relative to the other causes sliding movement of the slidable plate when the rows of teeth are engaged;

(b) wheel rotation retardation means actuable between a non-braking position and a braking position; and (c) interconnection means connecting the slidable plate with the wheel rotation retardation means in a manner such that sliding movement of the plate in either direction from a first non-braking position to a second braking position actuates the wheel retardation means from a non-braking position to a braking position.

2. Side-actuated braking system as defined by claim 1, wherein the wheel rotation retardation means comprises at least one caliper comprising a pair of levers movable between an open position and a closed position, said caliper being adapted for arrangement on a foot vehicle so that in a closed position the pair of levers grips a wheel of the foot vehicle to provide a braking action; and further wherein the interconnection means connects the slidable plate with the caliper in a manner such that sliding movement of the plate from a first non-braking position to a second braking position moves the caliper from open position to closed position.

3. Side-actuated braking system as defined by claim 2, wherein the wheel rotation retardation means includes two calipers, each of which calipers comprises a pair of levers and each of which calipers is movable between an open position and a closed position, the calipers being adapted for arrangement on a foot vehicle so that in closed positions they each grip a respective wheel of the foot vehicle to provide braking action, the interconnection means connecting the slidable plate with each caliper in a manner such that sliding movement of the plate from a first non-braking position to a second braking position moves each caliper from open position to closed position.

4. Side-actuated braking system as defined by claim 2, wherein the slidable plate is spring biased in a non-braking position.

5. Side-actuated braking system as defined by claim 4, wherein the caliper is spring biased in an open position.

6. Side-actuated braking system as defined by claim 2, wherein one of the levers of the caliper is located above the slidable plate and the other of the levers of the caliper is located below the slidable plate, which levers are commonly mounted on a stationary pivot post extending through a guide slot provided in the slidable plate.

7. Side-actuated braking means as defined by claim 2, wherein the levers and the slidable plate are arranged in planes generally parallel with each other, and wherein the interconnection means comprises a pair of cam slots provided in the slidable plate and a follower pin extending from each lever into the respective cam slot, the cam slot being of a configuration which, as the slidable plate is moved from a first non-braking position to a second braking position, acts as a cam to move the respective follower pin and lever attached thereto to closed position.

8. Side-actuated braking system as defined by claim 3, wherein one of the levers of each caliper is located above the slidable plate and the other of the levers of each caliper is located below the slidable plate, the two levers of each caliper being commonly mounted on a stationary pivot post extending through a guide slot provided in the slidable plate.

9. Side-actuated braking system as defined by claim 8, wherein the interconnection means comprises two cam slots provided in the slidable plate and a combination follower and link pin extending from each lever located above the slidable plate through one of the cam slots into a link pin slot provided in the lever of the opposite caliper located below the slidable plate, the cam slots being shaped and positioned in the slidable plate so that, as the slidable plate is moved from a first non-braking position to a second braking position, the cam slots act as cams to move the pins and the levers attached thereto to closed position, each of the link pin slots being shaped and positioned such that said movement of the pins causes the levers located below the slidable plate simultaneously to move to closed position.

10. Side-actuated braking system as defined by claim 2, wherein the interconnection means comprises (i) a cable having two end portions and an intermediate portion, (ii) an anchor block located on and securing the ends of the cable to the slidable plate, (iii) a lever pulley secured to each lever of the caliper, and (iv) a pair of central pulleys mounted adjacent the anchor block, the central pulleys being stationary contrasted to the slidable plate; and further wherein the intermediate portion of the cable travels around the lever pulleys and the end portions of the cable travel around one and between both of the central pulleys, and the anchor block and the central pulleys are positioned on respective mounting members so that, as the slidable plate is moved from a first non-braking position to a second braking position, the cable pulls on the lever pulleys and moves the levers from open position to closed position.

11. Side-actuated braking system as defined by claim 3, wherein the interconnection means comprises (i) a cable having two end portions and an intermediate portion, (ii) an anchor block located on and securing the ends of the cable to the slidable plate, (iii) a lever pulley secured to each lever of the calipers, and (iv) a pair of central pulleys mounted adjacent the anchor block, the central pulleys being stationary contrasted to the slidable plate; and further wherein the intermediate portion of the cable travels around the lever pulleys and each end portion of the cable travels around one and between both of the central pulleys, and the anchor block and the central pulleys are positioned on their respective mounting members so that, as the slidable plate is moved from a first non-braking position to a second braking position, the cable pulls on the lever pulleys and moves the levers from open position to closed position.

12. Side-actuated braking system as defined by claim 11, wherein at least one equalizing pulley and the pair of central pulleys are mounted on the vehicle and the anchor block is mounted on the slidable plate so that the equalizing and central pulleys are stationary contrasted to the slidable plate; and further wherein the pulleys and anchor block are positioned so that as the slidable plate is moved from a first non-braking position to a second position, the cable exerts equal forces on the lever pulleys after moving the levers from open position to closed position.

13. A pair of wheeled, foot vehicles adapted for use together, each of which foot vehicles comprises (a) a carriage frame with a platform for receiving a shod foot of a vehicle operator, the platform being provided with means for retaining the shod foot and bracing the ankle of the vehicle operator on the platform, the means comprising a first strap for retaining the front portion of the vehicle user's foot, a vertically extending brace mount secured to the edge of the platform, a brace link pivotally connected at its lower end to the brace mount, a stirrup for supporting the heel portion of the vehicle user's foot, the stirrup being pivotally connected with the brace link, and a second strap for retaining the vehicle user's leg at an area above the ankle, the second strap being pivotally connected with the brace link;

(b) at least two wheels, at least one of which is arranged at each end of the platform; and (c) a side-actuated braking means for the vehicle, comprising (i) a slidable plate provided at one edge with a row of teeth, said plate being attached to the foot vehicle so that the row of teeth extends outwardly and opposingly from a side of the foot vehicle to face and adapted for engagement with the respective row of teeth outwardly extending from the opposing side of the second of the pair of foot vehicles, whereby movement of either foot vehicle relative to the other causes sliding movement of both slidable plates when the rows of teeth are engaged;

(ii) wheel rotation retardation means associated with each wheel and actuable between a non-braking position and a braking position; and (iii) interconnection means connecting the slidable plate with the wheel rotation retardation means in a manner such that sliding movement of the plate from a first non-braking position to a second braking position actuates the wheel rotation retardation means from a non-braking position to a braking position.

14. A pair of wheeled, foot vehicles as defined by claim 13, wherein the wheel rotation retardation means comprises two calipers, each of which calipers comprises a pair of levers and each of which calipers is movable between an open position and a closed position, the calipers being arranged on the foot vehicle so that in closed positions they each grip a respective wheel of the foot vehicle to provide braking action, the interconnection means connecting the slidable plate with each caliper in a manner such that the sliding movement of the plate from a first position to a second position moves each caliper from open position to closed position.

* * * * *